United States Patent [19]

Behrens et al.

[11] 4,431,602

[45] Feb. 14, 1984

[54] PROCESS AND APPARATUS FOR CONDUCTING THE HOT GAS IN THE DRY SPINNING PROCESS

[75] Inventors: Hans-Josef Behrens, Dormagen; Heiko Herold, Neuss; Edgar Muschelknautz; Roland Vogelsgesang, both of Leverkusen, all of Fed. Rep. of Germany

[73] Assignee: Bayer Aktiengesellschaft, Leverkusen, Fed. Rep. of Germany

[21] Appl. No.: 426,307

[22] Filed: Sep. 29, 1982

[30] Foreign Application Priority Data

Oct. 20, 1981 [DE] Fed. Rep. of Germany ..... 3141490

[51] Int. Cl.[3] ..... B29F 3/08

[52] U.S. Cl. ..... 264/205; 264/206; 425/725

[58] Field of Search ..... 425/725; 264/204–207

[56] References Cited

U.S. PATENT DOCUMENTS

| | | | |
|---|---|---|---|
| 1,933,587 | 11/1933 | Dreyfus et al. | 264/207 |
| 2,047,313 | 7/1936 | Dreyfus et al. | 264/207 |
| 2,131,810 | 10/1938 | Kinsella et al. | 264/207 |
| 2,145,290 | 1/1939 | Bower | 264/207 |
| 3,271,818 | 9/1966 | Bryan | 425/725 |
| 3,366,722 | 1/1968 | Tessier | 425/725 |
| 3,465,618 | 9/1969 | McIntosh et al. | 425/725 |
| 3,814,559 | 6/1974 | Akers | 425/725 |
| 3,824,050 | 7/1974 | Balk | 425/725 |
| 3,847,522 | 11/1974 | Heckrotte et al. | 425/725 |
| 4,123,208 | 10/1978 | Klaver et al. | 425/725 |

*Primary Examiner*—Jay H. Woo

*Attorney, Agent, or Firm*—Sprung, Horn, Kramer & Woods

[57] ABSTRACT

In order to conduct thoroughly pre-mixed hot gas into a ring spinning nozzle by a rotational flow in such a manner that sufficient quantities of hot gas are available for drying the filaments situated on the inside without causing backflow and without any significant movement of the filaments by turbulence, an annular chamber with tangential inlet is placed around the ring spinning nozzle. The internal wall of the chamber is separated from a circular chamber by equalizers in its upper region while on its underside it is separated from the spinning chamber by equalizers and metal gauzes at the level of the lower edge of the spinning nozzle. The circular chamber is also separated on its underside from the spinning chamber by equalizers and metal gauzes.

6 Claims, 2 Drawing Figures

PROCESS AND APPARATUS FOR CONDUCTING THE HOT GAS IN THE DRY SPINNING PROCESS

BACKGROUND OF THE INVENTION

This invention relates to a process and an apparatus for conducting the hot gas in the manufacture of filaments by the dry spinning process, in which the hot gas catches the filaments immediately under the spinning nozzle.

The spinning chambers used for the production of filaments by the dry spinning process comprise two operational regions, namely the drop-chamber, which is usually circular in cross-section, and the spinning head mounted on the drop-chamber. The cross-section and length of the drop-chamber depend on the rate of throughput of polymer, the quantity of solvent and quantity of hot gas used for evaporating the solvent from the filaments. The drop-chamber is generally heated by a heating jacket at temperatures which are usually above the boiling point of the solvent.

The hot gas used may be air, but an inert gas is preferred. The hot gas acting on the filaments generally flows in the same direction as the filaments. The quantity and temperature of the gas depend on the nature of the polymer and of the solvent and on the spinning output, and are generally required to be determined experimentally on the basis of required quality of the given spinning material. Temperatures in the region of 150° to 400° C. are customarily employed.

The spinning head contains the assembly of a spinning nozzle, an apparatus for supplying and distributing the spinning solution, and filtering elements. The number of spinning apertures and their diameter and form depend on the nature of the polymer solution to be spun and the spinning output.

The nozzles used in the present invention are ring spinning nozzles in which the nozzle apertures are arranged in a circular ring. Pot nozzles are also known which have a circular surface with the nozzle apertures arranged either over the whole of this surface or on a peripheral circular ring of the surface.

The spinning head also contains devices for introducing the hot gas into the drop-chamber. In ring spinning nozzles, it is known to let the hot gas stream out both inside and outside of the ring.

The spinning nozzle is regulated so that the temperature of the spinning solution in it is noticeably below the evaporation temperature of the solvent. The temperature of the hot gas, on the other hand, must be higher than the evaporation temperature so that evaporation of the solvent may begin immediately beneath the spinning nozzle.

When the hot gas is inside the spinning head, and indeed above the spinning die, it generally flows axially. The velocity of the gas is so low that only a minimal pressure loss occurs across the metal gauges closing the air flow regions off from the drop-chamber. This pressure loss is not sufficient to have any significant equalizing effect on turbulence and temperature differences. The flow velocities are so low that sufficient mixing does not occur.

If the gas flow has not been balanced, it causes unsteady flow underneath the spinning nozzle, so that the extruded monofilaments which still contain large quantities of solvent undergo transverse movements which lead to fluctuations in the titre of the individual filaments and to filaments sticking together. Such spinning defects cause problems in the subsequent after-treatment of the filaments and the yarn manufacturing process and are therefore undesirable.

It is known to improve the equalization of the gas flow by feeding in the gas above the spinning nozzle radially or tangentially at a high velocity transversely to the general direction of the filaments and producing an annular rotation flow (U.S. Pat. Nos. 2,615,198, 3,509,244, 3,111,368 and 4,123,208). This requires the use of a pot nozzle since a rotational flow extending to the center produces a high vacuum at the center which would be, however, covered by the spinning nozzle. A pot nozzle has, however, the fundamental disadvantage that, even when the spinning apertures are arranged in a circular ring, the filaments situated more centrally are not so easily reached by the hot gas and are therefore not sufficiently dried. If a ring nozzle which is open at the center were used, on the other hand, the vacuum produced with the rotational flow would cause severe backflow within the set of filaments and would therefore also lead to spinning defects.

In order to obtain equal drying of the internally and externally situated filaments, it is proposed, in U.S. Pat. No. 4,123,208 to carry hot gas inwardly through radial bores in the nozzle assembly of the pot nozzle. These bores, however, can only carry very small quantities of gas inwards. The gas passes through the nozzle assembly, cools down and thereby heats the nozzle assembly. The effect obtained does not even approximate that obtained with a ring spinning nozzle.

SUMMARY OF THE INVENTION

It is an object of this invention that a hot gas which has been thoroughly premixed by a rotational flow should be carried through a ring spinning nozzle in such a manner that adequate quantities of hot gas will be available on the inside for drying the inner filaments, without resulting in any backflow or any significant movement of the filaments by turbulence.

As far as the process is concerned, the problem is solved by sub-dividing the rotating stream of hot gas into two quantitatively adjustable partial streams situated respectively internally and externally of the ring spinning nozzle and deflecting these streams of hot gas into streams parallel to the direction of draw-off of the filaments and stabilizing them.

As regards the apparatus, the problem is solved by a spinning head in which the assembly of spinning nozzles is in the form of a ring spinning nozzle, characterized in that the spinning head has an annular chamber with a tangential inlet around the spinning die, the internal wall of the annular chamber being closed in the upper region by equalizers while the underside is closed off a the level of the lower edge of the spinning nozzle by equalizers and metal gauzes, and in that inside the ring spinning nozzle, the spinning head has circular chamber communicating with the outer annular chamber by way of the upper equalizers and provided at the lower edge with additional equalizers and metal gauzes at the level of the lower edge of the ring spinning nozzle. A preferred embodiment has, in addition, an annular pre-chamber into which the tangential inlet opens. The pre-chamber communicates with the annular chamber by way of adjustable inlet apertures as well as communicating directly with the circular chamber, though there is no direct communication between the annular chamber and the circular chamber. Also, a cylindrical plunger is situated at the center of the circular chamber.

A narrow gap is preferably left between the equalizers and the metal gauzes which are situated downstream of the equalizers.

The equalizers may be, for example, pipe packs, vertical packs of corrugated sheet metal or aluminum honeycombs.

The process and the apparatus according to the invention are described below by way of example, with reference to the accompanying drawings, wherein:

DETAILED DESCRIPTION OF THE INVENTION

Figure 1:
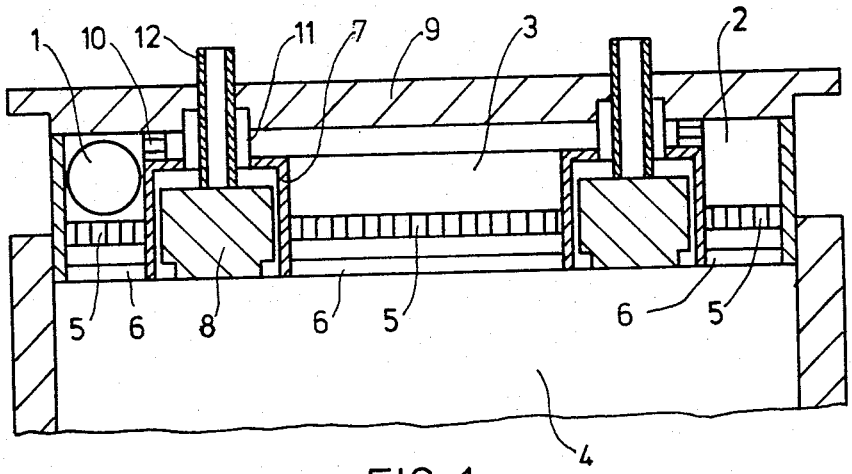
FIG. 1 is a cross-section through a spinning head according to the invention.

FIG. 1 shows the tangential inlet 1 and the outer annular chamber 2 communicating with the inner circular chamber 3. Both chambers are separated from the drop-chamber 4 by equalizer packs 5 and metal gauzes 6. Situated between the shield 7 covering the spinning nozzle assembly 8 and the cover 9 covering the spinning head are an equalizer pack 10 and protective tubes 11 which sheath the connections 12 to the nozzle (connection for solution and inlet and outlet for cooling fluid).

Figure 2:
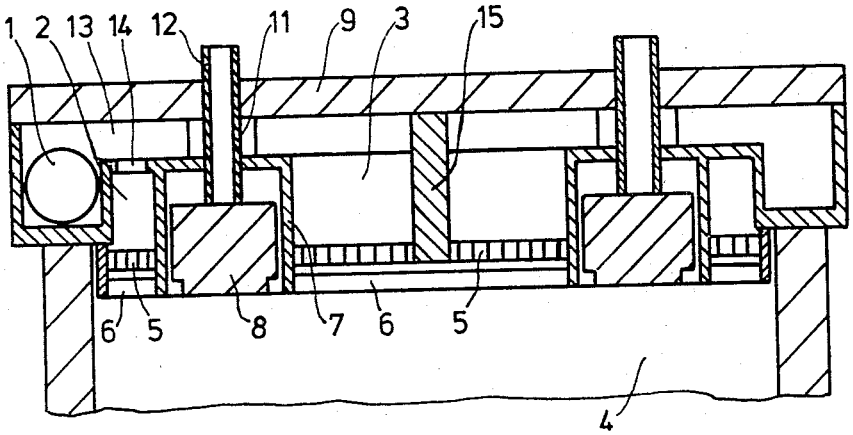
FIG. 2 is a cross-section through a spinning head with an additional pre-chamber according to the invention.

FIG. 2 illustrates a modified apparatus in which a pre-chamber 13 directly connected to the inner circular chamber 3 is provided before the outer annular chamber 2. The annular chamber 2 and pre-chamber 13 communicate through oblique slots 14. The center of the inner circular chamber is occupied by the cylindical plunger 15.

In FIG. 1, hot gas enters the outer annular chamber 2 via the tangential inlet 1 and rotates in chamber 2 at high speed. At the equalizer pack 10, a partial stream is peeled off above the shield 7 of the spinning nozzle and carried radially to the inner circular chamber. To prevent heat being transmitted to the nozzle connections 12 extending through the cover 9 of the spinning head, the connections 12 are surrounded by protective tubes 11 of larger diameter. The hot gas in the inner annular chamber 3 is carried once more through a equalizer pack 5 to straighten out any residual rotation. A residual rotating stream left in the outer annular chamber 2 is also deflected by the equalizer pack 5 therebelow so that after leaving pack 5, the hot gas flows parallel to the filaments leaving the spinning nozzle assembly 8. To smooth out any turbulence in the hot gas, the gas is passed through the metal gauze 6 before reaching the drop-chambers 4.

In FIG. 2 the rotational flow required for equalizing the hot gas is first produced in a pre-chamber 13 which communicates directly with the inner annular chamber 3. The center of the annular chamber 3 in which a high vacuum would be produced by rotational flow is filled by the cylindrical plunger 15 which prevents backflow from the drop-chamber 4. The peeling off of a partial stream in the outer annular chamber 2 is effected by slots 14, the rotational flow initially being preserved to a large extent. Deflection of the flow, so that it is directed parallel to the filaments, is effected both on the outside and on the inside by the equalizer packs 5 which again have metal gauzes 6 arranged in series with them to smooth out the turbulence. The rotational velocity in the outer annular chamber should be from 10 to 200 times, preferably from 20 to 80 times, greater than the average velocity of the heat in the drop-shaft.

The outer surface area available for air flow is generally 4 to 7 times as great as the central area for air flow. Both areas together take up about 30 to 40% of the total cross-sectional area available in the drop-chamber.

When the hot gas is conducted in accordance with the invention, hardly any movement of the spinning filaments in the spinning chamber is observed, and the uniformity of the filaments is improved.

EXAMPLE 1

A solution of an acrylonitrile polymer (94% by weight acrylonitrile, 6% by weight methyl acrylate) in dimethyl formamide with a solid content of 30% by weight was spun from a 700 aperture nozzle at a throughput rate of 10.2 kg of solid substance per hour. The solution was at a temperature of 135° C. The extruded filaments which had an individual titre of 10 dtex were subjected to about 40 $Nm^3/h$ of air. The air was at a temperature of 350° measured immediately below the inner cross-section of air flow. The chamber temperature was 180° C.

A conventional spinning head with a ring spinning nozzle in which the metal gauze closing the air flow regions was exposed to an axial flow was used in the first experiment. The flow velocities were about 0.6 m/s in the outer air flow region and about 1 m/s in the inner region.

A spinning head with ring spinning nozzle with rotational flow was used in the second spinning experiment. The apparatus with a pre-chamber, illustrated in FIG. 2, was chosen.

The rotational velocity in the twisting chamber was approximately 31 m/s. The axial velocity of the outside and inside were substantially preserved.

The gap between equalizers and metal gauze was 5 mm in height. The equalizers were in the form of packs of corrugated sheet metal.

The failure rate of 1 $^{\circ}/_{oo}$ when using the conventioı spinning head was 10 times higher than that occurring with the twist spinning head.

EXAMPLE 2

An elastic polyurethane fiber with diamine extender was spun. The solid content was 22%, the solvent was used dimethyl acetamide. The filament thickness was 400 dtex/f 36.

Both when using the conventional spinning process with axial flow and when using the process with rotational flow in a spinning head according to FIG. 1, approximately 30 $Nm^3/h$ of air at an average temperature of 270° C. was injected for drying the filament.

With this rate of air flow, rotational velocities of 22 m/s was obtained in the twist spinning head. Honeycomb grids were used as equalizers. The gap between equalizer and screen was 5 mm in height.

When using a conventional spinning head, the maximum temperature deviations of 60° C. occurring 100 mm below the spinning die were approximately 3 times greater than in the twist spinning head of FIG. 1.

Evaluation of the uniformity of titre showed maximum deviations of ±10 dtex in the conventional process and maximum deviations of ±6 dtex in the process with rotational flow, based on the nominal titre.

It will be appreciated that the instant specification and claims are set forth by way of illustration and not limitation, and that various modifications and changes may be made without departing from the spirit and scope of the present invention.

What is claimed is:

1. In a process for conducting hot gas in the manufacture of filaments by the dry spinning process with a ring spinning nozzle, wherein the hot gas is set into a rotational flow above the ring spinning nozzle, the improvement comprising the steps of: subdividing the hot gas into two quantitatively adjustable partial streams, one disposed outside and one disposed inside of the ring spinning nozzle; deflecting the streams parallel to the direction of draw-off of the filaments; and subsequently stabilizing the streams.

2. The process according to claim 1, wherein the gas velocity parallel to the filaments is 10 to 200 times smaller than the minimum rotational velocity.

3. In an apparatus for conducting hot gas in the manufacture of filaments by the dry spinning process and having a ring spinning nozzle in a spinning head, the improvement comprising: means forming a circular chamber inside the ring spinning nozzle and an annular chamber outside the ring spinning nozzle and around the circular chamber and having a tangential pipe inlet; first equalizers separating the upper region of the internal wall of the annular chamber from the circular chamber; second equalizers and metal gauzes separating the underside of the annular chamber from the spinning chamber at the level of the lower edge of the ring spinning nozzle; means providing communication between the outer annular chamber and the circular chamber comprising the first equalizers; and third equalizers and metal gauzes separating the underside of the circular chamber from the spinning shaft at the level of the lower edge of the ring spinning nozzle.

4. The apparatus according to claim 3, wherein the metal gauzes are disposed downstream of the equalizers with a narrow gap between the gauzes and the equalizers.

5. In an apparatus for conducting hot gas in the manufacture of filaments by the dry spinning process and having a ring spinning nozzle inside a spinning head, the improvement comprising: means forming a circular chamber inside the ring spinning nozzle and an annular chamber outside the ring spinning nozzle and an annular pre-chamber having a tangential pipe inlet situated externally upstream on the annular chamber; means providing direct communication between the pre-chamber and the circular chamber; means forming stabilizer adjustable inlet passages connecting the pre-chamber with the annular chamber; a cylindrical plunger disposed at the center of the circular chamber, and equalizers and metal gauzes separating the annular chamber and circular chamber from the spinning chamber therebelow and disposed at the level of the lower edge of the ring spinning nozzle.

6. The apparatus according to claim 5, wherein the metal gauzes are disposed downstream of the equalizers with a narrow gap between the gauzes and the equalizers.

* * * * *